US005454262A

United States Patent [19]

Westermeyer

[11] Patent Number: 5,454,262

[45] Date of Patent: Oct. 3, 1995

[54] PROCESS AND APPARATUS FOR OPERATING A PRESS UNIT

[75] Inventor: Walter Westermeyer, Neuss, Germany

[73] Assignee: Pahnke Engineering GmbH & Co. KG, Dusseldorf, Germany

[21] Appl. No.: 938,729

[22] Filed: Aug. 31, 1992

[30] Foreign Application Priority Data

Sep. 27, 1991 [DE] Germany ..... 41 32 220.7

[51] Int. Cl.[6] ..... B21D 43/10; B21J 13/10

[52] U.S. Cl. ..... 72/421

[58] Field of Search ..... 72/420, 421, 405

[56] References Cited

U.S. PATENT DOCUMENTS

| | | | |
|---|---|---|---|
| 3,267,708 | 8/1966 | Sims et al. | 72/421 |
| 3,427,853 | 2/1969 | Thomas | 72/420 |
| 3,473,364 | 10/1969 | Ross | 72/421 |
| 3,504,512 | 4/1970 | Knowles | 72/421 |
| 3,715,908 | 2/1973 | Schussler | 72/420 |
| 4,031,736 | 6/1977 | Kutz | 72/420 |
| 4,120,185 | 10/1978 | Schneider et al. | 72/421 |

FOREIGN PATENT DOCUMENTS

| | | | |
|---|---|---|---|
| 2746161 | 4/1979 | Germany | 72/421 |
| 1037114 | 7/1966 | United Kingdom | 72/421 |

*Primary Examiner*—Lowell A. Larson
*Assistant Examiner*—Donald M. Gurley
*Attorney, Agent, or Firm*—Anderson Kill Olick & Oshinsky

[57] ABSTRACT

In a process for operating a press unit comprising a press, more particularly a forging press, having a hydraulic driving and control system that causes the working stroke movement of the press to follow a substantially sinusoidal course, and at least one integrated forging manipulator, synchronization of the working stroke of the press and the stroke of the tong arm of the manipulator is effected by a driving and control system of the forging manipulator by which a stroke movement of the tong arm of the forging manipulator adjusted to match the working stroke of the press and having the same frequency as that of the working stroke movement of the press, but with a smaller amplitude, is produced. For raising and lowering of the tong arm at least one continuously variable, reversible-flow pump is associated with the forging manipulator.

6 Claims, 1 Drawing Sheet

STROKE-
TIME
H
h
H/2
h/2
MANIPULATOR PRESS
PRESS & MANIPULATOR CONTROL SYSTEM
1
2
3
4
5
6
7
8
9
11
11R
12
13
14
15
16
17
18
19
21
22
23
24
30
31
32
33
34
35
36
37
38

PROCESS AND APPARATUS FOR OPERATING A PRESS UNIT

TECHNICAL FIELD THE INVENTION

The present invention relates to a process and apparatus for operating a press unit comprising a press, more particularly a forging press, having a hydraulic driving and control system that causes the working stroke movement of the press to follow, at least at times, an approximately sinusoidal course, and an integrated forging manipulator.

BACKGROUND OF THE INVENTION AND PRIOR ART

From DE-PS 25 03 143 a high-speed forging press is known that is driven by continuously variable reversible-flow pumps having a controlled working stroke that is sinusoidal in the reversing phases (modified sine drive). This forging press has a retraction drive that is independent of the main drive and has a constant retraction force, a reversible decompression valve connected in parallel to the drive pumps and a control unit to open the decompression valve at the lower reversal point of the press stroke. The object of this is to obtain optimum freedom from surging for the hydraulic system of the oil-hydraulic drive despite the high operating speed. A contribution is made to this by special dimensioning of the opening area of the decompression valve, namely such that the pressure relief of the working cylinder of the press occurs partly through the decompression valve and partly through the drive pumps that are reversed to suck the pressure medium out of the working cylinder.

Meanwhile similar units have been built that also have retraction systems that make use of the reversed flow of one or more main pumps so as to avoid the need for control valves in the main circuits.

The above-mentioned press unit is a forging press with at least one integrated manipulator that runs on rails and in which the stroke movement of the press and the feed movement of the manipulator that guides the workpiece through the press are coordinated so that a workpiece with a predetermined form can be obtained.

In all forging presses of conventional construction the lower die of the press is fixed during the forging process, while the upper die carries out the working movement. As a result, however, the middle axis of the workpiece is unavoidably moved downwards in each working stroke during the shaping of the workpiece. The forging manipulator has to follow this displacement of the axis of the workpiece, which can be done for example through resilient mounting of the tong arm, as otherwise distortion of the workpiece cannot be avoided.

A wide variety of such resilient mountings, based on mechanical or hydraulic elements, are known, e.g. from DE-AS 22 55 009, DE-OS 15 27 354 or DE-GM 86 200 700.8. To reduce the bending forces acting on the workpiece as far as possible, the restoring forces of the springs are adapted to the load or load moment of the forging manipulator. This so-called passive springing cannot however provide completely trouble-free operation when forging rods, since on striking the workpiece the press accelerates the mass of the workpiece and the mass of the tong system downwards, with a lever action that varies with the distance of the manipulator from the press (i.e. as the length of the workpiece increases). Through the forces thus set up the workpiece is distorted and sometimes remains hanging on the edges of the die, which greatly interferes with the feeding of the workpiece.

Instead of using a resilient mounting it is also known to perform a controlled lowering or stroke movement of the tong arm (see DAS 1 296 117, DOS 1 527 261 and DAS 1 627 414). It is found, however, that satisfactory results cannot be obtained in this way, this being connected with the fact that in the case of forging presses with valve control the working speeds are normally very variable and the switching time needed for the tracking by the forging manipulator or its manipulator elements.

A hydraulic coupling between press and manipulator can— at any rate theoretically—be obtained with the forging apparatus according to DAS 1 627 414. This coupling, however, has disadvantages that arise from the great length of the connecting line needed between the auxiliary cylinder unit employed in the press and the lowering cylinder unit of the manipulator. Since the manipulators sometimes have to travel distances as long as 23 meters and more, a rapid working movement of the press gives rise to compression and decompression surges in the connecting line, which because of the travel of the manipulator has to be a hose, which bring the system out of its synchronous rhythm.

OBJECT OF THE INVENTION

It is an object of the invention to provide, for a press unit of the kind referred to, a process and apparatus with which synchronization of the working stroke movements of the press and the stroke movements of the tong arm of the manipulator can be achieved without the said disadvantages.

SUMMARY OF THE INVENTION

To this end, according to the invention, a driving and control system of the forging manipulator produces a stroke movement of the tong arm of the forging manipulator that is adjusted to match the working stroke movement of the press without time delay and with the same frequency as the working stroke movement of the press, though with a smaller amplitude. The invention is based on the discovery that in the case of a press unit of the kind referred to the synchronization problem can be solved amazingly simply, and in a way different from all previous developments, by using for the synchronous movement of the forging manipulator, i.e. for lowering and raising the tong arm and thereby keeping the axis of the workpiece straight during the onging, a driving and control system that has long been known for forging presses themselves. By the use of a driving and control system that produces an approximately sinusoidal course of the working stroke movement for a forging manipulator as well, and the combination with a forging press having such a driving and control system, the suspension of the manipulator is compelled to move in a manner adapted to the movement of the press. In this way coordinated movements of the forging press and the manipulator, or its tong arm as the case may be, can be obtained. All that is then required for the synchronization is to adjust the two drives to the same frequency.

If the stroke movement of the tong arm is adjusted to have half the amplitude of the working stroke movement of the press, the tong arm raising and lowering the forging workpiece vertically can correspondingly match the rhythm of the movement of the press, since as a rule the movement of the tong arm is already ended when the upper saddle of the press has still to travel half its path. The different amplitudes can be obtained by supplying different amounts of the hydraulic fluid to the driving and control systems and adapting their cylinders to the necessary forces.

It is proposed to give a control signal for operating the press simultaneously with a control signal for performing the stroke movement of the tong arm. A control signal for the pumps of the main drive of the forging press thus arrives simultaneously with a control signal given to a pump that effects the stroke of the tong arm.

According to the invention the forging manipulator is provided with a continuously variable, reversible-flow pump for raising and lowering the tong arm. With such a reversible-flow pump it is possible to produce, in unison with the corresponding driving and control system of the forging press, a coordinated, approximately sinusoidal course of movement of the press and tong arm.

Advantageously a synchronous cylinder unit of the tong arm, which serves to raise and lower the tong arm and thus the workpiece in the rhythm of the working stroke movement of the press, is connected to the reversible-flow pump.

It is advisable to connect a compensating cylinder of the tong arm to an accumulator. The compensating cylinder, supported with pressure from the accumulator, counterbalances the weight of the workpiece and the tong arm.

BRIEF DESCRIPTION OF THE DRAWINGS

The invention will now be described in more detail by way of example with reference to the embodiment illustrated in the drawings, in which.

DETAILED DESCRIPTION OF PREFERRED EMBODIMENTS OF THE INVENTION

Figures 1, 2A, 2B:
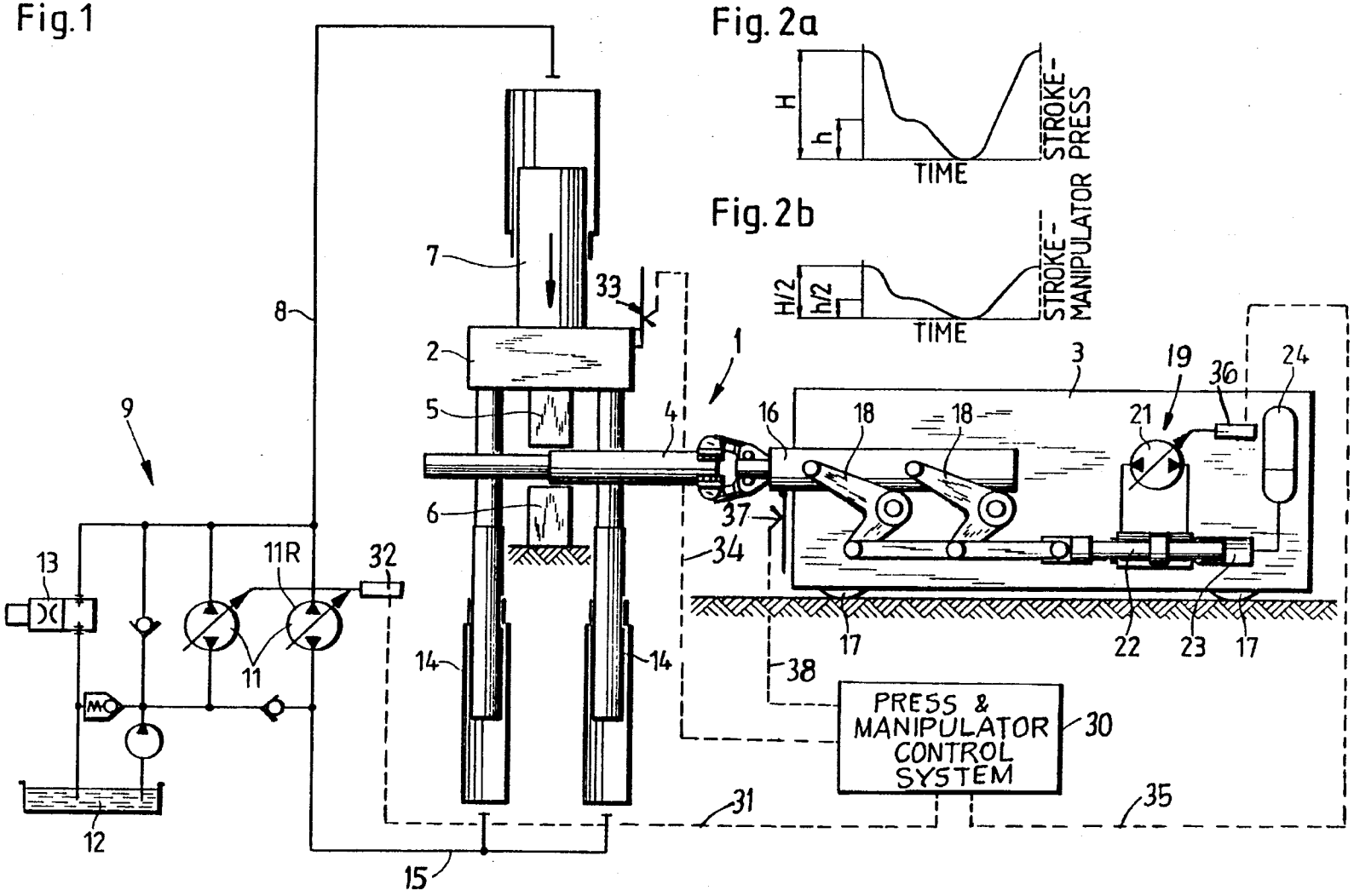
FIG. 1 shows an overall view of a press unit comprising a forging press with an integrated forging manipulator.
FIG. 2*a*, 2*b* respectively show diagrams representing the working stroke movement of the press and the raising and lowering movements of the tong arm.

The press unit 1 shown comprises a forging press 2 with an integrated forging manipulator 3. For forging a workpiece 4 the forging press 2 has a movable upper die 5 and a fixed lower die 6. The upper die 5 is driven by a working cylinder 7 that is connected by way of supply lines 8 to a driving and control system 9. This has as its main drive two reversible-flow pumps 11 which are connected, in addition to the supply lines 8, to a pressure medium container 12 and a decompression valve 13 to avoid switching surges. For retraction of the forging press 2, i.e. of its upper die 5, retraction cylinders 14 are provided that are connected by way of pressure medium lines 15 to the pumps 11, the retraction being performed, e.g., by the right-hand pump 11R after the reversal of the direction of flow, or by an accumulator system as described in DE-PS 25 03 143. Alternatively the retraction movements of the forging press 2 can be effected by pumps independent of the main driving pumps 11.

The workpiece 4 being worked between the dies 5, 6 of the forging press 2 is gripped in the manipulator tongs of a tong arm 16 of the forging manipulator 3, which can travel on wheels 17 in order to perform the feeding movement of the workpiece 4. The manipulator tongs or the tong arm 16 is mounted resiliently in the vertical direction by way of bent levers 18 of a hydraulic driving and control system 19, and in order to keep its axis horizontal the workpiece 4 is lowered during the forging by amounts corresponding to its decreasing dimensions. So that the tong arm 16 and correspondingly the workpiece 4 are lowered in the rhythm of the working stroke movements of the upper die 5 of the forging press 2, the driving and control system 19 includes a continuously variable reversible-flow pump 21 that is connected to a synchronized cylinder unit 22 that effects the raising and lowering of the tong arm 16 by adjusting the bent levers 18. In addition a compensating cylinder unit 23 is provided that is connected to an accumulator 24 and counterbalances the weight of the workpiece 4 and the tong arm 16.

Because of the continuously variable reversible-flow pumps 11 and 21 integrated in the respective driving and control systems 9 and 19 of both the forging press 2 and the forging manipulator 3, driving systems can be realised that operate without valves in the main circuit to give synchronized movements of the working stroke of the upper die 5 of the forging press 2 and the raising and lowering movement of the tong arm 16 and hence of the workpiece 4, so that these movements follow an approximately sinusoidal course. Synchronization of the course of the movements is obtained by electronic adjustment of the respective driving systems 9 and 19 to the same frequency, but with the stroke movement of the tong arm 16 having a smaller amplitude, preferably amounting only to half the amplitude of the working stroke movement of the forging press 2. As can be seen from FIG. 2*a* for the course of the working stroke movement of the forging press 2, and from FIG. 2*b* for the upward and downward movement of the tong arm 16, the movements take place simultaneously and with matched amplitudes.

The driving systems 9 and 19 of the forging press (2) and the forging manipulator (3), respectively, are controlled by the press control system (30) formed as a computer- or microprocessor-based control system. The control system (30) is connected by signal conduits 31 and 35 with variators 32 and 36 of the press main pumps 11 and 11R and the manipulator lift pump (21), respectively. The actual stroke of the press 2 is sensed by a sensor 33 which is connected with the control system 30 by a conduit 34. The actual stroke of the manipulator tong arm 16 is sensed by a sensor 37 which is connected by conduit 38 with the control system.

Synchronization of movement of the press 2 and the tong arm 16 is effected by simultaneously communicating actuation signals to the main pumps variator 32 and the lift pump variator 36 causing the press 2 and the tong arm 16 to perform strokes as illustrated in diagrams shown in FIGS. 2*a* and 2*b*, respectively. The control system 30 effects stroke adjustment of the press 2 and the manipulator tong arm 16 in accordance with the feedback signals received from the press stroke sensor 33 and the tong arm stroke sensor 37.

While the preferred embodiments of the invention have been depicted in detail, modifications and adaptations may be made thereto, without departing from the spirit and scope of the invention, as delineated in the following claims:

What is claimed is:

1. A process for operating a press unit comprising a forging press having a hydraulic driving and control system that causes the working stroke movement of the press to follow, at least at times, an approximately sinusoidal course, and at least one tong arm forging manipulator, said process comprising the steps of:

producing a vertical stroke movement of the tong arm by a driving and control system of the forging manipulator;

adjusting the stroke movement of the tong arm to match the working stroke movement of the press, without any time delay, with the same frequency as that of the working stroke movement of the press but with a smaller amplitude, by simultaneously providing a control signal for operation of the press and a control signal for performance of the stroke movement of the tong arm.

2. A process according to claim 1, wherein the stroke movement of the tong arm is adjusted to have half the amplitude of the working stroke movement.

3. A process according to claim 2, wherein the hydraulic cylinder unit of the hydraulic driving and control system of the manipulator comprises at least one continuously variable, reversible-flow pump for raising and lowering the tong arm.

4. A process according to claim 3, wherein the tong arm comprises a synchronized cylinder unit, which is connected to the reversible-flow pump.

5. A process according to claim 3, wherein the tong arm comprises a compensating cylinder unit, which is connected to an accumulator.

6. A process according to claim 1, wherein the driving and control system of the forging manipulator comprises a hydraulic driving and control system, wherein the hydraulic driving and control system, the forging press and the hydraulic driving and control system of the forging manipulator each include a hydraulic cylinder unit for generating necessary forces, and wherein different amplitudes of the press and the tong arm are controlled by supplying different amounts of hydraulic fluid to respective hydraulic cylinder units.

* * * * *